US005326080A

United States Patent [19]

Seroldi

[11] Patent Number: 5,326,080

[45] Date of Patent: Jul. 5, 1994

[54] APPARATUS FOR TIGHTENING BANDS, IN PARTICULAR BANDS AS FITTED TO FURNITURE FRAMES

[75] Inventor: Giuseppe Seroldi, Seregno, Italy

[73] Assignee: INTES S.A.S. Di Giuseppe Seroldi E.F. LLI & C., Novedrate, Italy

[21] Appl. No.: 824,559

[22] Filed: Jan. 23, 1992

[30] Foreign Application Priority Data

Apr. 24, 1991 [IT] Italy ..... MI91U-000362

[51] Int. Cl.[5] ..... B66D 1/34; A44B 11/12

[52] U.S. Cl. ..... 254/219; 24/68 R

[58] Field of Search ..... 254/199, 202, 213, 219, 254/241; 38/102, 102.91; 24/16 R, 68 CD, 68 D, 68 R, 69 R, 69 ST, 70 T, 70 JT, 72.7

[56] References Cited

U.S. PATENT DOCUMENTS

| | | | |
|---|---|---|---|
| 763,781 | 6/1904 | Nicholson | 24/68 R X |
| 2,881,636 | 4/1959 | Palmleaf | 254/213 X |
| 3,035,814 | 5/1962 | Mosey et al. | 254/241 X |
| 3,080,148 | 3/1963 | Knoebel et al. | 254/219 |
| 3,265,355 | 8/1966 | Martin et al. | 254/219 X |
| 3,686,715 | 8/1972 | Brodnicki | 24/68 CD |
| 4,430,814 | 2/1984 | Wulc | 38/102.91 |
| 4,483,516 | 11/1984 | Wehr | 254/199 |
| 4,584,741 | 4/1986 | Kawahara et al. | 24/68 R X |
| 4,681,359 | 7/1987 | Stolz | 254/119 X |
| 5,018,708 | 5/1991 | Shaffer | 254/213 X |

*Primary Examiner*—Clifford D. Crowder
*Assistant Examiner*—Ismael Izaguirre
*Attorney, Agent, or Firm*—Notaro & Michalos

[57] ABSTRACT

An apparatus for tightening elastic and non-elastic bands designed for fitting to the frames of pieces of furniture includes a tensioner consisting of a roll arranged for rotation about its own axis. The roll has a pressure member mounted in spaced relationship with the roll so as to permit insertion of bands therebetween. The supplied band is folded backwardly over the top of the pressure member to be fastened to the frame of the piece of furniture. During a first rotation of the roll, the pressure member applies, by friction, a slight tractive force on the band, while permitting it to run with respect to the roll. A subsequent rotation of the roll brings the backwardly folded portion of the band to bear on that portion of the band supplied from the reel, which lies on the least one portion of the surface of the roll, whereby running of the band is then prevented by friction such that a further rotation of the roll causes tightening of the band.

4 Claims, 3 Drawing Sheets

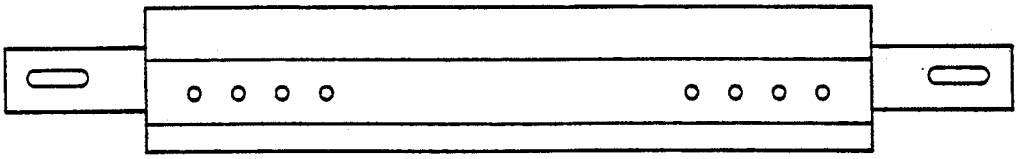
FIG. 4
FIG. 3
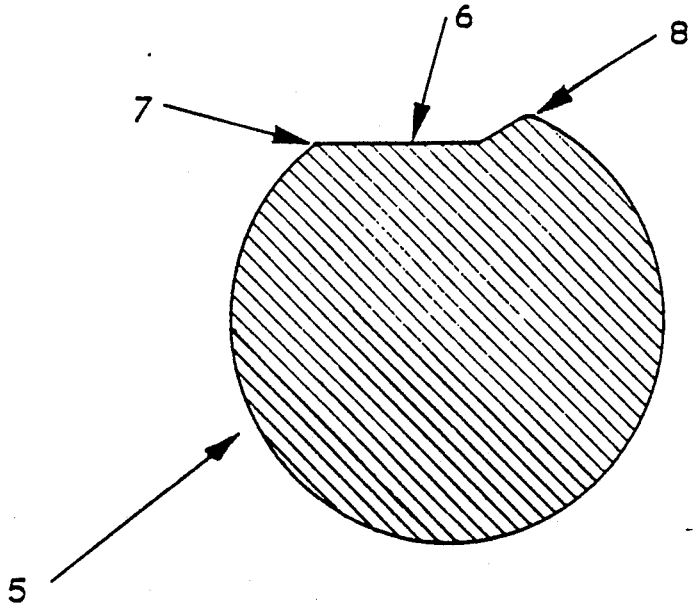

APPARATUS FOR TIGHTENING BANDS, IN PARTICULAR BANDS AS FITTED TO FURNITURE FRAMES

FIELD AND BACKGROUND OF THE INVENTION

This invention is relating to an apparatus for the even tightening of a series of elastic and non-elastic bands of the type as fitted to the frames of pieces of furniture such as armchairs, settees or the like.

This apparatus is particularly designed for tightening bands which require a substantial force to be tightened and which are subject to undergo a minimum elongation.

The apparatus according to this invention is characterized in that it is simple in construction and, thus, easy and practical to use, as well as of lower cost as compared with other, known apparatus for performing the same function.

When manufacturing pieces of furniture such as armchairs, settees, chairs or the like, it is often usual to fit the frames of these pieces of furniture with series of parallel belts made of elastic material, to which a stuffing material is subsequently mounted as necessary.

These belts have to be tightened in a uniform manner and, to this end, machines are provided for putting a plurality of parallel belts or bands in tension and for fitting them to support frames of pieces of furniture, which machines are arranged to supply the belts and to tighten them with a substantially uniform force.

One of these machines known is disclosed in Italian Patent N. 979.355 granted Sep. 30, 1974, and comprises a set of rolls causing the parallel bands to move to a working table, and means for inverting the direction of rotation of said rolls so as to tighten the bands after an operator has attached the ends thereof to a frame of piece of furniture to permit the bands to be fixed to an opposite side of the frame, whereupon the bands are cut.

These machines also include sensing means to sense tension of the bands, which are able to stop the tension rolls automatically.

Said means is a roll mounted to pneumatic supports which press the roll against the bands. When a force of reaction produced by the bands, upon the bands reaching a required tension, acts so as to cause this roll to move backwardly, a microswitch will operate to stop operation of the machine.

However, some problems arise with this known apparatus when the bands to be fitted to a frame are elastic bands requiring a high tension and having a minumum rate of elongation.

In this apparatus, in fact, the belts run between a pair of opposed rolls which cause the bands to advance and which subsequently apply a pull thereon to put the bands under tension, and, in case of high strength bands, it would be necessary for these bands to be tightened between the rolls with a substantial amount of pressure which is often such as to be likely to damage the bands. In a similar manner, it would be also necessary for the tension roll to be subjected to a great pressure which may give rise to many troubles as a result.

SUMMARY OF THE INVENTION

This invention aims at solving the above problem. To this end, the invention provides an apparatus of the type as referred to above, wherein the tension element is a roll provided with a pressure device, and wherein the bands are partially wound around said roll, passed between the roll and the pressure device and folded backwardly to permit the ends of the bands to be fastened to a considered frame.

By causing the roll to rotate about its own axis, the elastic belts are slightly tightened by the pressure device. The roll conformation is such that, as rotation thereof is continued, the belts remain firmly clamped to the roll by friction and are tightened in a uniform manner with the tension being proportional to the extent of rotation of the roll.

BRIEF DESCRIPTION OF THE DRAWINGS

The invention will now be described in full details by way of a non limiting example, reference being made to the accompanying drawings, in which:

FIG. 3 is a cross-sectional view of the tension roll taken along an orthogonal plane to the axis;

FIG. 4 is a view of the tension roll.

DESCRIPTION OF THE PREFERRED EMBODIMENT

Figure 1:
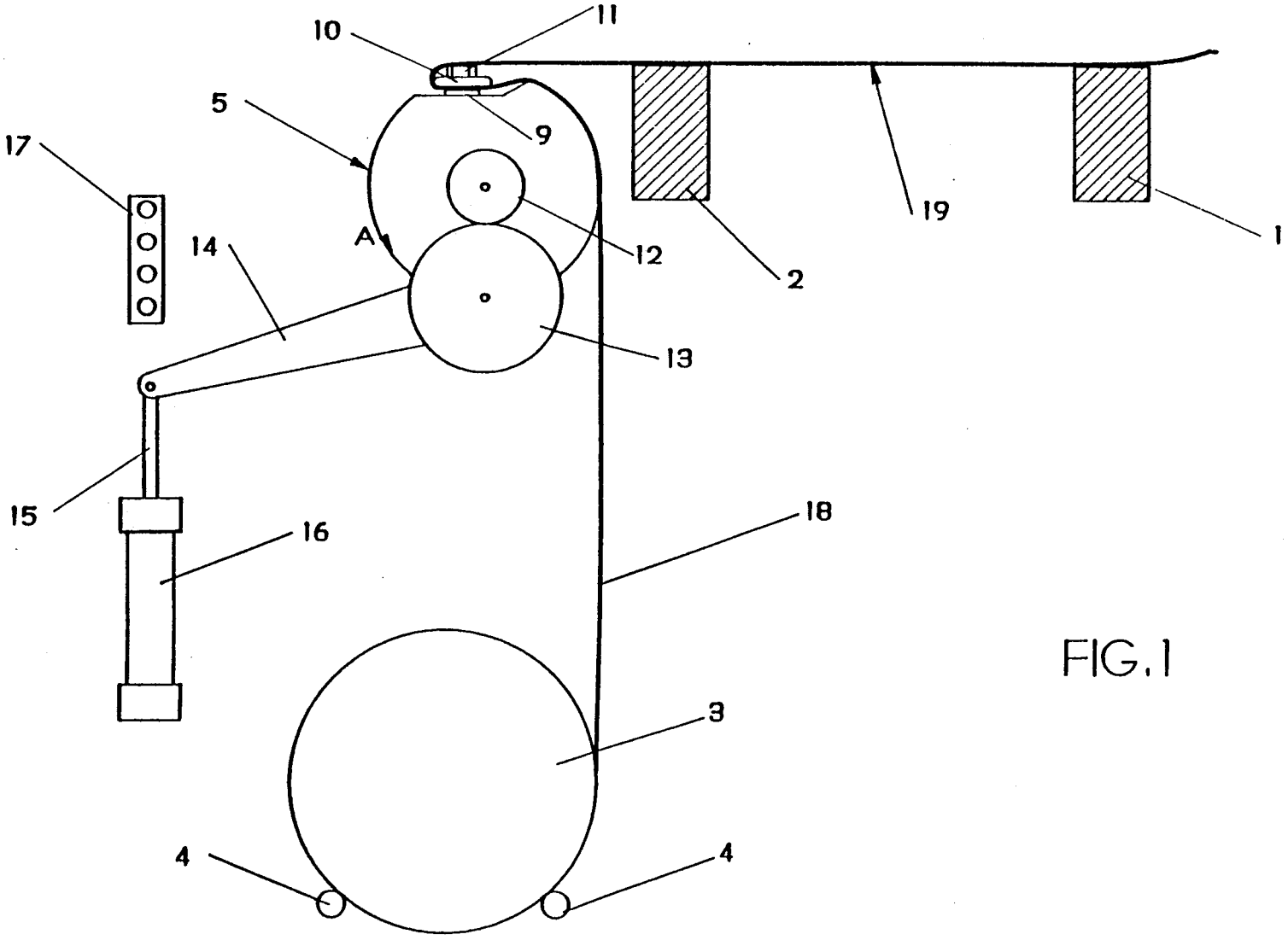
FIG. 1 is a schematic view of a tension device in a machine according to this invention, the position being that at the start of a tightening cycle.

Referring now to FIG. 1, there is shown by numerals 1 and 2 two opposite sides, respectively, of a furniture support frame which has to be fitted with elastic belts.

These belts are supplied from a plurality of reels 3 arranged side-to-side and bearing on a pair of small wheels 4 permitting smooth unwinding of the belts.

The drawings do not show the machine frame, and only the parts of the machine that are essential for understanding operation thereof have been shown for the sake of clarity.

The tension device comprises a tension roll 5, as best seen FIG. 3, in which roll a recess having a bottom wall 6 is provided, this bottom wall 6 forming on one side, an edge 7 with the adjacent roll surface, while, on the other side, the wall 6 bends upwardly to meet the roll surface at a rounded edge shown by reference numeral 8.

Secured to wall 6 is a plurality of spacers 9 to which a bar or pressure member 10 is mounted and is fastened by the aid of screws 11 or the like.

The roll 5 has a gear wheel 12 coaxially fixed thereto, which meshes with a second gear wheel 13 having an arm 14 fixed to it, this arm 14 being hinged at its other end to a piston rod 15 of a pneumatic piston 16.

Arranged along the path of arm 14 are stop means 17 which may for example be microswitches located at different levels, or the like devices connected with control devices so as to stop operation of the machine when engaged by arm 14.

Shown at 18 is one of the belts which are taken off the reels 3 to be attached to a furniture frame and put in tension by the apparatus.

Operation is as follows:

Each belt 18 is taken off by hand by winding it partially around the roll 5 at a region thereof facing the furniture frame, and is inserted between the roll and the pressure member 10 by passing the belt over the rounded roll edge 8, whereupon the belt is folded backwardly over the top of pressure member 10 and moved on so as to bring the belt end to the edge 1 of the furniture frame to which the belt is fastened in a known manner as, for example, by means of claw fasteners, nails, or the like.

The above operation is performed for all of the belts.

If, in this position, the roll 5 is rotated in the direction of arrow A, the side edge of pressure member 10 will exert on the belt a given pull by friction, the belt being however allowed to run between the roll and the pressure member.

Figure 2:
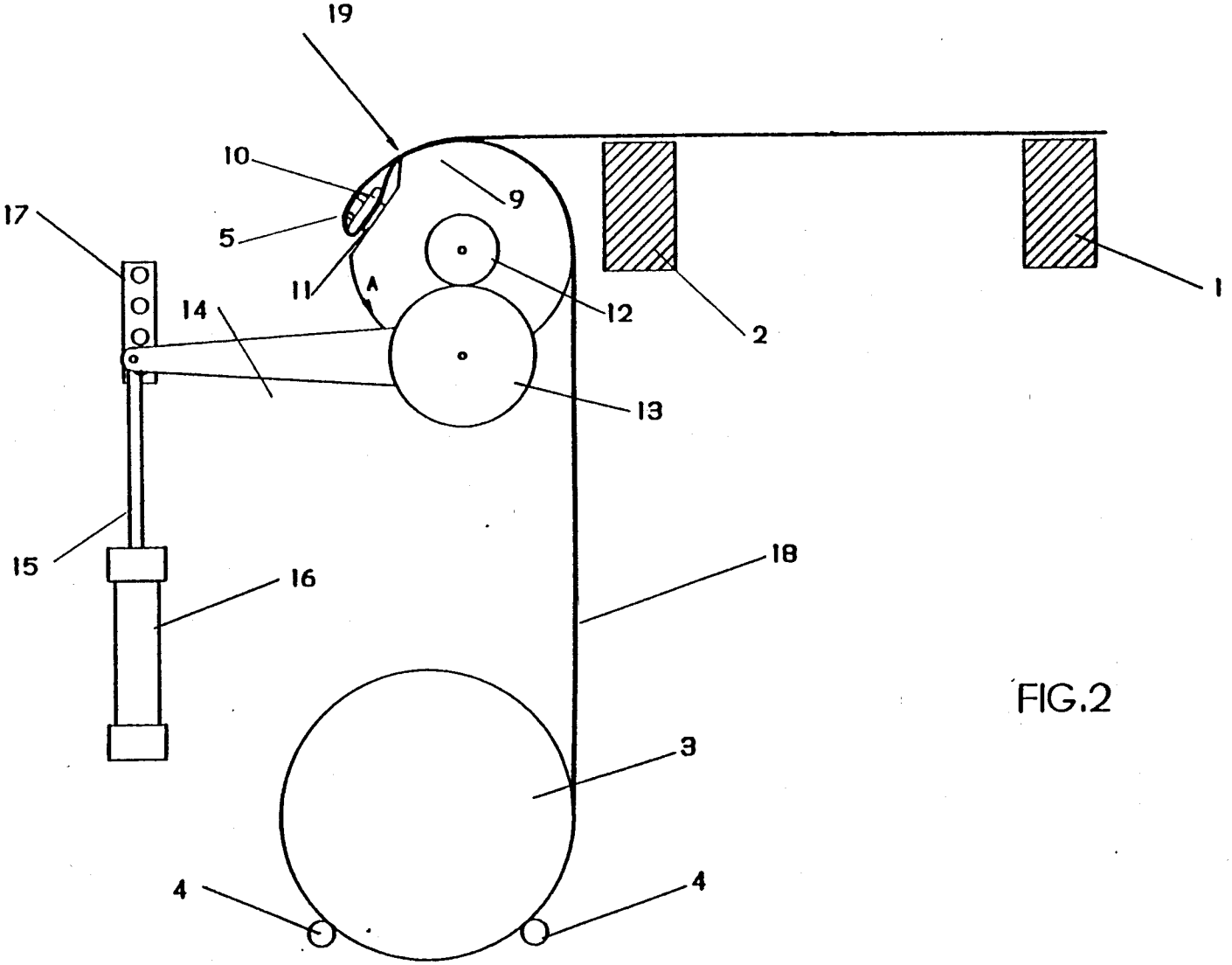
FIG. 2 is a view similar to that in FIG. 1 with the machine being in a position as occurring in the course of a tightening cycle.

Thus, during a first rotation of roll 5, the belts, which are fastened to side 1 of the furniture frame, are put under slight tension substantially with the same force. By continued rotation of roll 5, the roll 5 will attain a position as shown FIG. 2, wherein a belt portion—designated by numeral 19—downstream of pressure member 10 lies on the belt portion 18 wound around the roll 5, and the tension of said belt portion 19 causes the two superposed belt portions to press against one another thereby to firmly clamp the belt portions together by friction: as a result, the second rotation step of roll 5 causes tightening of the belts with a force which is proportional to the extent of rotation of the roll.

By properly adjusting the limit switches 17, it is possible to stop operation of piston 16 and, thus, rotation of roll 5 so as to permit all of the belts to be tightened with the desired force.

The above described apparatus is considerably simple in construction as compared with prior known apparatus and, as a result, lower in cost and easy to use even by unskilled operators.

It should be apparent that both the sizes and the materials used may be varied depending on particular application requirements.

I claim:

1. A band tightening apparatus comprising:

a roll rotatable about an axis; and a pressure member having a top and mounted to the roll and spaced away from the roll, the pressure member allowing a portion of a band to be inserted between the pressure member and the roll wherein the band is folded over the top of the pressure member, the pressure member applying a slight tractional force to the band during a first rotation of the roll while permitting the band to run between the pressure member and the roll, the band being prevented from running between the pressure member and the roll through subsequent rotations of the roll through a frictional force caused by the band being pressured against itself, the pressure member comprising a bar parallel to the axis of the roll, and the roll having a recess thereon, the recess having a flat bottom wall, the flat bottom wall having spacer means secured thereto, and the bar being mounted to the spacer means.

2. The band tightening apparatus according to claim 1, including a pneumatic piston, and a lever operatively connected to the pneumatic piston and the roll, the pneumatic piston and the lever causing the roll to rotate.

3. The band tightening apparatus according to claim 2, including a first gear wheel mounted to the axis of the roll and a second gear integrally formed with the lever, the second gear wheel being larger in diameter than the first gear wheel and being engaged with the first gear wheel.

4. The band tightening apparatus to claim 3, including at least one limit switch in a path of the lever and engagable with the lever.

* * * * *